US009153401B2

(12) United States Patent
Kimura et al.

(10) Patent No.: US 9,153,401 B2
(45) Date of Patent: Oct. 6, 2015

(54) PROTECTIVE DEVICE

(75) Inventors: Yuji Kimura, Ishikawa (JP); Youzo Ohashi, Ishikawa (JP); Takahiro Asada, Ishikawa (JP)

(73) Assignee: Dexerials Corporation, Tokyo (JP)

( * ) Notice: Subject to any disclaimer, the term of this patent is extended or adjusted under 35 U.S.C. 154(b) by 151 days.

(21) Appl. No.: 13/145,611

(22) PCT Filed: Jan. 14, 2010

(86) PCT No.: PCT/JP2010/050334

§ 371 (c)(1), (2), (4) Date: Sep. 21, 2011

(87) PCT Pub. No.: WO2010/084817

PCT Pub. Date: Jul. 29, 2010

(65) Prior Publication Data

US 2012/0001720 A1 Jan. 5, 2012

(30) Foreign Application Priority Data

Jan. 21, 2009 (JP) ..... P2009-011196

(51) Int. Cl.
*H01H 85/046* (2006.01)
*H01H 37/76* (2006.01)
(Continued)

(52) U.S. Cl.
CPC ..... *H01H 37/761* (2013.01); *H01H 85/046* (2013.01); *H01H 1/5805* (2013.01); *H01H 2037/768* (2013.01); *H01H 2085/0414* (2013.01)

(58) Field of Classification Search
CPC ..... H01H 37/761; H01H 1/5805; H01H 2037/768; H01H 85/046; H01H 2085/0414
USPC ..... 337/297, 153, 182, 183, 186, 187
See application file for complete search history.

(56) References Cited

U.S. PATENT DOCUMENTS 3,354,282 A * 11/1967 Batsch ..... 337/234
4,198,617 A * 4/1980 Hara ..... 337/403
(Continued)

FOREIGN PATENT DOCUMENTS

EP 1424711 A1 6/2004
JP 2000-285777 A 10/2000
(Continued)

OTHER PUBLICATIONS

Extended European Search Report mailed Mar. 27, 2014, in corresponding European Application No. 10733424.5 (6 pages).
(Continued)

*Primary Examiner* — Anatoly Vortman
(74) *Attorney, Agent, or Firm* — Osha Liang LLP

(57) ABSTRACT

A protective device for protecting equipment includes an insulation base substrate, a fusible conductor arranged on the insulation base substrate and connected to a power supply path for the equipment so that the fusible conductor is fused off by a preset abnormal current or voltage, an insulation cover mounted on the insulation base substrate to overlie the fusible conductor via a preset spacing, and a flux coated on a surface of the fusible conductor and disposed in the spacing. The fusible conductor is fused off to break a current path when the abnormal voltage is applied to the equipment. The fusible conductor is secured to a conductor layer and to pair electrodes provided on the insulation base substrate via an electrically conductive paste containing a metal component exhibiting wettability with respect to the fusible conductor in the fused state.

7 Claims, 7 Drawing Sheets

(51) Int. Cl.

| | |
|---|---|
| *H01H 85/041* | (2006.01) |
| *H01H 1/58* | (2006.01) |

(56) References Cited

U.S. PATENT DOCUMENTS

| | | | | |
|---|---|---|---|---|
| 5,097,247 | A * | 3/1992 | Doerrwaechter | 337/405 |
| 5,631,621 | A * | 5/1997 | Nakajima | 337/280 |
| 5,659,284 | A * | 8/1997 | Olofsson | 337/290 |
| 5,712,610 | A * | 1/1998 | Takeichi et al. | 337/290 |
| 5,760,676 | A * | 6/1998 | Yamada | 338/22 R |
| 5,939,969 | A * | 8/1999 | Doerrwaechter et al. | 337/297 |
| 5,982,268 | A * | 11/1999 | Kawanishi | 337/297 |
| 6,040,754 | A * | 3/2000 | Kawanishi | 337/297 |
| 6,198,376 | B1 * | 3/2001 | Ishikawa et al. | 337/297 |
| 6,222,438 | B1 * | 4/2001 | Horibe et al. | 337/290 |
| 6,300,859 | B1 * | 10/2001 | Myong et al. | 337/182 |
| 6,373,371 | B1 * | 4/2002 | Doerrwaechter et al. | 337/297 |
| 6,452,475 | B1 * | 9/2002 | Kawazu et al. | 337/290 |
| 7,042,327 | B2 * | 5/2006 | Tanaka et al. | 337/290 |
| 2002/0014945 | A1 * | 2/2002 | Furuuchi et al. | 337/158 |
| 2002/0113685 | A1 * | 8/2002 | Izaki et al. | 337/405 |
| 2002/0149899 | A1 * | 10/2002 | Kladar et al. | 361/127 |
| 2003/0156007 | A1 * | 8/2003 | Senda et al. | 337/401 |
| 2004/0070486 | A1 * | 4/2004 | Senda et al. | 337/405 |
| 2004/0085178 | A1 * | 5/2004 | Tanaka et al. | 337/159 |
| 2004/0100352 | A1 * | 5/2004 | Tanaka | 337/159 |
| 2004/0174243 | A1 * | 9/2004 | Tanaka | 337/159 |
| 2004/0196133 | A1 * | 10/2004 | Kawanishi | 337/159 |
| 2005/0001710 | A1 * | 1/2005 | Mukai et al. | 337/297 |
| 2005/0007233 | A1 * | 1/2005 | Tanaka | 337/159 |
| 2005/0140491 | A1 * | 6/2005 | Uehara et al. | 337/401 |
| 2005/0264394 | A1 * | 12/2005 | Furuuchi | 337/182 |
| 2006/0097839 | A1 * | 5/2006 | Tanaka | 337/159 |
| 2007/0024407 | A1 * | 2/2007 | Senda et al. | 337/159 |
| 2010/0085141 | A1 * | 4/2010 | Knab et al. | 337/227 |
| 2010/0109833 | A1 * | 5/2010 | Knab et al. | 337/413 |
| 2011/0181385 | A1 * | 7/2011 | Schulze-Icking-Konert et al. | 337/290 |

FOREIGN PATENT DOCUMENTS

| | | | |
|---|---|---|---|
| JP | 2004-214032 | A | 7/2004 |
| JP | 2004-265617 | A | 9/2004 |
| JP | 2004-363630 | A | 12/2004 |
| JP | 2008-302407 | A | 12/2008 |

OTHER PUBLICATIONS

International Search Report w/translation from PCT/JP2010/050334 (3 pages), Feb. 2010.

* cited by examiner

PROTECTIVE DEVICE

TECHNICAL FIELD

This invention relates generally to a protective device including a fusible conductor that, when excess current flows through or excess voltage is applied to electronic equipment, is fused off under the heat generated to break the current.

BACKGROUND ART

A conventional protective device, mounted on say a secondary cell device, has a protective function not only against over-current but also against over-voltage. This protective device includes a heating member and a fusible conductor layered on the heating member via an insulation layer. The fusible conductor is formed by a segment of a low melting metal and may be fused off by over-current. In case of an over-voltage, current is supplied to the heating member in the protective device, and the fusible conductor is fused off due to heating of the heating member. The fusible conductor may be fused off as a result of high wettability of the fusible conductor of a low melting metal in the fused state against the surface of the conductor layer the fusible conductor is connected to. The low melting metal in the fused state is drawn close to a conductor layer, such as an electrode, as a result of which the fusible conductor is fused off to break the current.

On the other hand, in keeping up with reduction in size of the electronic equipment, such as mobile equipment, reduction in size or thickness and stability of the operation as well as a high operating speed may be beneficial. In light of this, a protective device having a fusible conductor of low melting metal is arranged on an insulation substrate and sealed with an insulation cover, and in which the fusible conductor is coated with a flux. This flux is provided to prevent oxidation of the surface of the fusible conductor and to allow the fusible conductor to be fused off promptly and stably at the time of heating of the fusible conductor.

Such a type of the protective device is shown in FIGS. 13 and 14. This protective device includes a heating member 2 of a resistance material between a pair of electrodes 5*a* provided on both ends of a base substrate 1. A conductor layer 4 connected to one of the electrodes 5*a* is provided on top of the heating member 2 via insulation layer 3. Another pair of electrodes 5*b* is provided on the lateral sides of the base substrate 1. A fusible conductor 6, formed by a low melting metal piece, is connected between the electrodes 5*b* by a solder paste 7. The fusible conductor 6 is also connected to an underlying conductor layer 4 by the solder paste 7. A flux 8 is coated on the fusible conductor 6 on the base substrate 1, and an insulation cover 9 is mounted to overlie the base substrate 1.

The fusion/disruption of the fusible conductor 6 of the low melting metal due to over-current may occur as follows: When the fusible conductor 6 is fused, the fusible conductor 6 in the fused state is drawn close to the conductor layer 4 and the electrodes 5*b*, because of wettability of the fusible conductor 6 with respect to the surfaces of the electrodes 5*b* or the conductor layer 4 the fusible conductor is connected to. As a result, the fusible conductor 6 between the electrodes 5*b* is disrupted to break the current. Hence, this wettability markedly influences the current breaking characteristic.

A protective device, improved in fusion characteristic in light of the wettability and the aggregation performance at the time of fusion/disruption of the fusible conductor, is disclosed in Patent Document 1. The protective element includes an insulation substrate, a pair of electrodes mounted spaced apart from each other on the surface of the insulation substrate, and a fusible alloy conductor connected between the pair electrodes. The protective element also includes a flux deposited on the fusible alloy conductor and an insulation/sealing material that overlies the flux. An underlying layer, whose wettability against the fusible alloy conductor in the fused state is smaller than that of the insulation substrate, is formed at the fusible alloy conductor forming position. When the fusible alloy conductor is fused, the fused alloy conductor is flipped by the underlying layer and hence is disrupted promptly. Moreover, no sparking is produced at the time of fusion/disruption. The fusible alloy may readily be aggregated by its surface tension onto the electrode to ensure reliable disruption.

Another protective device to shorten the circuit breaking time due to aggregation of the low melting metal at the time of fusion/disruption is disclosed in Patent Document 2. In Patent Document 2, two or more strands of low melting metal are provided between a pair of electrodes designed to cause the current to flow through the low melting metal. In so doing, the low melting metal between the electrodes is separated into independent sections to increase the number of fusion/disruption start points in the low melting metal to have the operating time shortened and improve stability.

PATENT PUBLICATIONS

Patent Publication 1: Japanese Laid-Open Patent Publication 2000-285777

Patent Publication 2: Japanese Laid-Open Patent Publication 2004-214032

As shown in FIGS. 13-15, the fusible conductor 6 fused off aggregates on the conductor layer 4 and comes into contact with the inner surface of the insulation cover 9. Heat is dissipated to prolong the time of fusion/disruption. In particular, if the protective device is reduced in size and thickness, the insulation cover 9 is lowered in height (thereby reducing the space for fusion between the base substrate 1 and the insulation cover) and the fused metal is likely to be in contact with the inner surface of the insulation cover 9. Accordingly, it is extremely difficult to reduce thickness of the protective device and shorten or stabilize the time duration of fusion/disruption simultaneously.

On the other hand, the fusible conductor 6 is coated with the flux 8 to prevent the fusible conductor 6 from becoming oxidized. However, on the pair electrodes 5*b* on both sides, to which the fusible conductor 6 in the fused state is spread as it exerts a wetting action, the flux 8 may not be coated. Consequently, the electrode surface tends to be oxidized to lower wettability. If the surfaces of the electrodes 5*b* are oxidized, the fusible conductor 6 in the fused state may not be spread sufficiently on the surfaces of the electrodes 5*b* as the fused metal exerts its wetting action. That is, the fusible conductor 6 in the fused state may be spread, as it exerts its wetting action, only on a portion of the surface of the conductor layer 4 the fusible conductor 6 is connected to. The fusible conductor 6 in the fused state should ideally be spread, as it exerts the wetting action, on the entire surfaces of the conductor layer 4 and the electrodes 5*b* the fusible conductor is connected to. In the conventional configuration, however, the fusible conductor 6 in the fused state is not spread but is heaped to contact with the inner surface of the insulation cover 9, as shown in FIGS. 14, 15. Thus, heat is dissipated to prolong the time of fusion/disruption.

This may adversely affect fusion/disruption only in cases when the flux of high activity is used. Halogen-free fluxes can be used to reduce the load imposed on environment by the material. In general, halogen-free fluxes are rather low in activity, so that, if the flux 8 is applied on the fusible conductor 6, the fusible conductor 6 in the fused state may not be spread, as it exerts the wetting action, on the conductor layer 4 or on the electrodes 5*b*. Thus, there are difficulties in fusing the fusible conductor 6 off promptly and stably.

In the protective device disclosed in Patent Document 1, an underlying layer whose wettability with respect to the fused alloy is lower than that of the insulation substrate is formed, and the fusible conductor 6 in the fused state is flipped by the underlying layer. Hence, the fused alloy is heaped to a higher height. That is, with reduction in height of the insulation cover, the probability that the fused alloy comes in contact with the inner surface of the insulation cover is greater.

The protective device, disclosed in the Patent Document 2, is smaller in size. Consequently, the fused metal is more likely to come into contact with the insulation cover. Moreover, since two or more strands of low melting metal are provided to segment the low melting metal, special metal molds would have to be provided to produce the protective device; thus, the production cost is increased.

SUMMARY OF THE INVENTION

One or more embodiments of the present invention provide a protective device in which the fusible conductor may be fused/disrupted promptly and stably for protection against over-current or the like.

According to one or more embodiments of the present invention, a protective device is provided for protecting equipment from unusual (abnormal) voltage. The protective device includes a fusible conductor, an insulation cover and a flux. The fusible conductor is arranged on an insulation base substrate and connected to a power supply path for the equipment for protection so that the fusible conductor will be fused off by a preset unusual current or voltage. The insulation cover is mounted on the base substrate to cover the fusible conductor via a preset spacing, and the flux is coated on the surface of the fusible conductor and is disposed in the spacing. The fusible conductor is fused off to break its current path in case the unusual voltage is applied to the equipment. The fusible conductor is secured to a conductor layer and to a pair of electrodes provided on the base substrate via an electrically conductive paste containing a metal component exhibiting high wettability with respect to the fusible conductor in the fused state. The electrically conductive paste is spread more outwards on the conductor layer than the rim of the fusible conductor.

The melting point of the metal component in the electrically conductive paste is lower than that of the fusible conductor. In particular, the electrically conductive paste is a solder paste that immobilizes the fusible conductor to the conductor layer and to the electrodes. The electrically conductive paste is provided on the electrodes in such a manner that it is spread more outwardly than the rim of the fusible conductor. After the solder paste has immobilized the fusible conductor on the electrode surface, the solder paste remains spread, as the flux component is still left.

The electrically conductive paste is spread radially on the surface of the conductor layer from the rim of the fusible conductor. In addition, the electrically conductive paste is spread radially on the surfaces of the electrodes from the rim of the fusible conductor.

The electrically conductive paste is also spread on the surface of the conductor layer from the rim of the fusible conductor to the rim of the conductor layer. Furthermore, the electrically conductive paste is spread on the surfaces of the electrodes from the rim of the fusible conductor to the rim of the electrodes.

The insulation cover includes, in a mid portion of its inner surface, a plurality of ribs that hold the flux in position.

With the protective device according to one or more embodiments of the present invention, should the fusible conductor be fused off, the fused metal is spread reliably and widely on the electrode surface and on the surface of the conductor layer as the fused metal wets these surfaces. The spreading, thus, ensures a stabilized fusion/disruption. Moreover, since the fusible conductor is not in contact with the insulation cover, there is no delay in the operation of fusion/disruption, thus allowing for a more stable positive operation such as to contribute to reduction in thickness of the protective device.

The solder paste used for immobilizing the fusible conductor may be used as the electrically conductive paste. That is, it is only necessary to change the pattern of the solder paste to immobilize the fusible conductor; it is unnecessary to increase the number of process steps or costs. Moreover, the surfaces of the electrodes or the conductor layer, provided with the solder paste, may be prevented from oxidization to prevent deterioration of wettability of the surfaces by the fused metal, thereby further stabilizing the fusion/disruption characteristics of the fusible conductor.

DETAILED DESCRIPTION OF THE INVENTION

Figure 1:
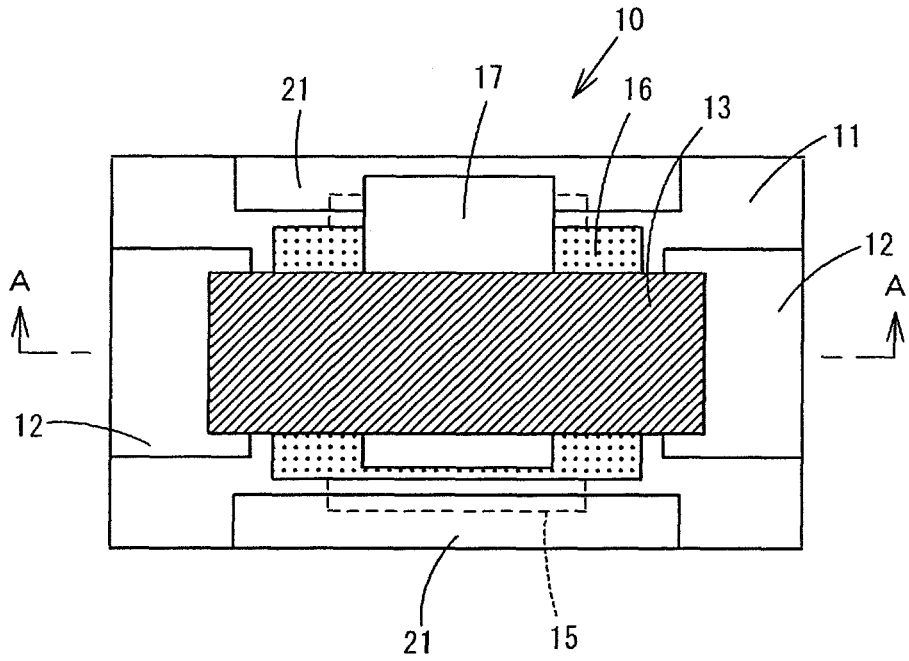
FIG. 1 is a plan view of a protective device with an insulation cover removed according to one or more embodiments of the present invention.

A protective device according to one or more embodiments of the present invention will now be described with reference to FIGS. 1 to 6. A protective device 10 includes an insulating base substrate 11 carrying thereon a pair of electrodes 12 and another pair of electrodes 21. The pair of electrodes 12 are mounted at both ends on an upper major surface of the insulating base substrate 11. The other pair of electrodes 21 are mounted on lateral side edges of the insulating base substrate 11 perpendicular to the pair electrodes 12. A heating member 15 composed of a resistor is connected to the pair electrodes 21. An electrically conductive layer 17, connected to one of the pair electrodes 21 via an insulation layer 16, is layered on top of the heating member 15. A solder paste 20 is coated on the electrically conductive layer 17 and on the pair of electrodes 12. A fusible conductor 13, a fuse formed of low melting metal, is connected to and secured between the pair of electrodes 12 with the solder paste 20. An insulation cover 14 of an insulation material for facing the fusible conductor 13 is mounted on top of the base substrate 11.

The base substrate 11 may be of any suitable material provided that the material is insulating. An insulating substrate routinely used as a substrate for a printed circuit board, such as ceramic substrate or glass epoxy substrate, for example, may be used. A glass substrate, a resin substrate and a metal substrate processed for insulation, may also be used depending on the application. A ceramic substrate, exhibiting high thermal resistance and high heat conductivity, is beneficial.

For the electrodes 12, 21 and the electrically conductive layer 17, a metal foil, such as copper foil, or an electrically conductive layer, having its surface plated with Ag—Pt or Au, may be used. The electrically conductive layer 17, as well as the electrodes 12, 21, obtained on coating an electrically conductive paste, such as Ag paste, on the base substrate 11, and sintering the resulting assembly, may also be used. Or, the electrically conductive layer 17 as well as the electrodes 12, 21 may be a thin metal film structure obtained using vapor deposition.

It is sufficient that the low melting metal foil of the fusible conductor 13 is melted at a preset electrical power. A variety of known low melting metals may be used as a fuse material. Examples of the fuse material include BiSnPb alloys, BiPbSn alloys, BiPb alloys, BiSn alloys, SnPb alloys, SnAg alloys, PbIn alloys, ZnAl alloys, InSn alloys and PbAgSn alloys.

The resistor that composes the heating member 15 may be obtained as follows: A resistor paste, composed of an electrically conductive material, such as ruthenium oxide or carbon black, an inorganic binder, such as glass and/or an organic binder, such as thermosetting resin, is coated on the base substrate 11, and the resulting product is sintered to yield the resistor. A thin film of ruthenium oxide and carbon black may also be printed on the base substrate 11 and a resulting product may then be sintered to yield the resistor. Or, ruthenium oxide and carbon black may be formed into a film by plating, vapor deposition or sputtering on the base substrate 11. Or, a film of the resistor material may be bonded or deposited on the base substrate 11 to form the resistor.

The insulation cover 14 having one of its lateral side opened is in the form of a casing. The insulation cover 14 is mounted on the base substrate 11 and is fitted on the base substrate 11 to delimit a preset spacing 18 between the insulation cover and the fusible conductor 13. It is sufficient that the insulation cover 14 is formed of an insulating material exhibiting thermal resistance high enough to bear the heat at the time of fusion/disruption of the fusible conductor 13 and also exhibiting mechanical strength appropriate to maintain the protective device 10. A variety of materials, including a substrate material used for a printed circuit board, such as glass, ceramics, plastics or glass epoxy resin, may be used. The insulation cover may also be formed by a metal sheet, whose side facing the base substrate 11 has an insulation layer, such as insulation resin layer. In one or more embodiments of the present invention, a material having high mechanical strength and a high insulation property, such as ceramics, is used to reduce thickness of the protective device.

Figure 2:
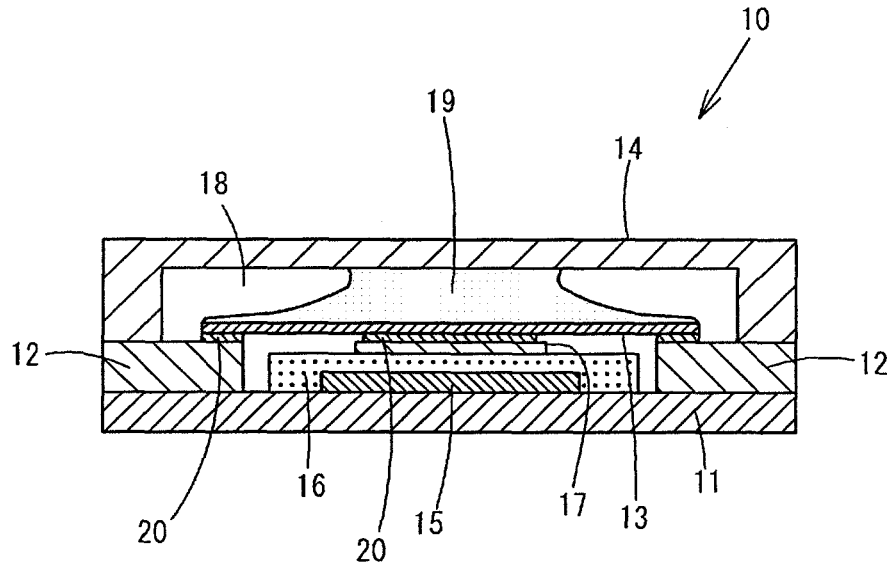
FIG. 2 is a cross-sectional view taken along line A-A of FIG. 1, with the insulation cover mounted in position.
Figure 3:
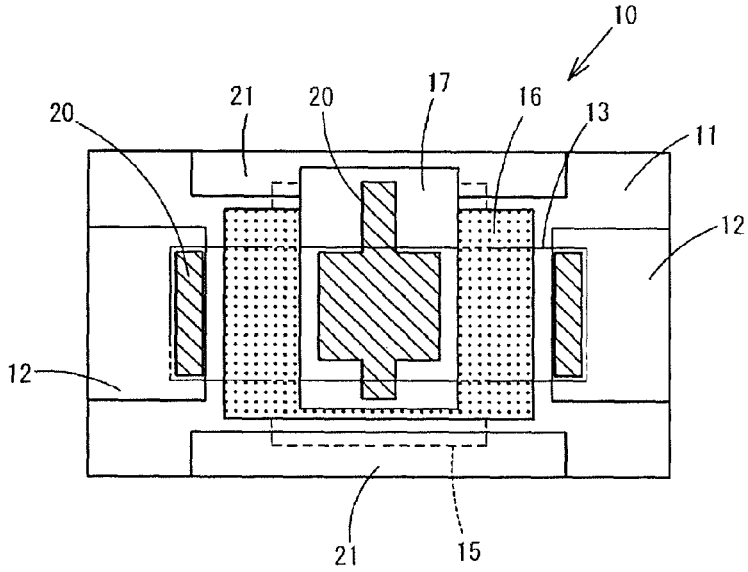
FIG. 3 is a plan view of the protective device according to one or more embodiments of the invention.

A flux 19 is provided on the entire surface of the fusible conductor 13 to prevent oxidation of the conductor surface. In one or more embodiments of the present invention, no halogen elements, such as bromine, are contained in the flux 19. The flux 19 is retained by surface tension on the fusible conductor 13 and accommodated in the spacing 18. The flux 19 is also affixed and retained to the inner surface of the insulation cover 14 by surface tension, as shown in FIG. 2.

The solder paste 20 contains a metal component exhibiting high wettability against the fusible conductor 13 which is in the fused state. The solder paste may be lead-free. For example, a zinc (Sn)-, silver (Ag)- or a copper (Cu)-based solder paste may be used. The solder paste is composed of a flux material containing metal alloy particles, such as particles of Sn alloys. The flux used in the solder paste may also be halogen-free. In one or more embodiments of the present invention, fusing temperature of metal alloy particles in the solder paste 20 may not be higher than the fusing temperature of the fusible conductor 13 and is as close to the fusing temperature of the fusible conductor 13 as possible. That is, the metal alloy particles in the solder paste 20 are fused at a temperature lower than the fusing temperature of the fusible conductor 13 by 10° C. or less. The coating pattern of the solder paste 20 is such that it deviates from a surface portion of the electrically conductive layer 17 of deposition of the fusible conductor 13 and extends towards the transverse edges of the electrically conductive layer 17. In addition, the solder paste 20 is coated on substantially the entire area of the portion of each of the pair of electrodes 12 where the fusible conductor 13 is deposited.

The fusible conductor 13 is placed on the portions of the pair of electrodes 12 and the electrically conductive layer 17 where the solder paste 20 has been printed to the above mentioned preset pattern. The resulting assembly then is cured in a reflow oven. The curing at this time is at a temperature for which the fusible conductor 13 is not completely fused. The fusible conductor 13 is thus fixed in position on top of the pair of electrodes 12 and the electrically conductive layer 17 in that the metal alloy particles in the solder paste 20 are not completely fused and the flux material is also left.

Figure 4:
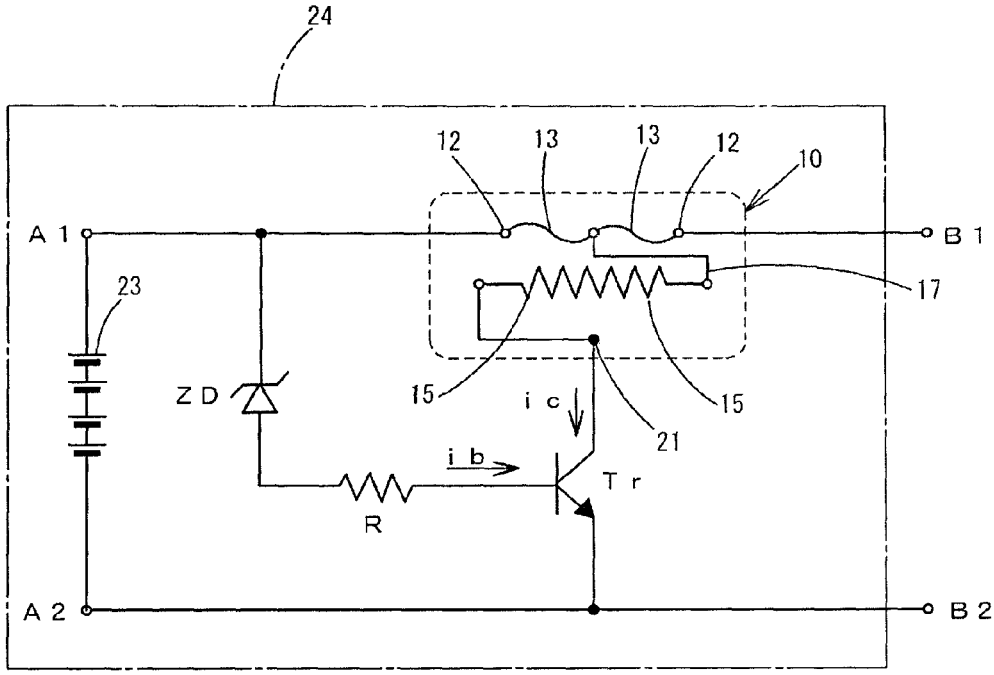
FIG. 4 is a circuit diagram of the protective device according to one or more embodiments of the invention.

As an example of using the protective device 10 according to one or more embodiments of the present invention, an over-current over-voltage protective circuit 24 for a secondary cell device will now be explained with reference to FIG. 4. In this over-current over-voltage protective circuit 24, the pair of electrodes 12 of the protective device 10 are connected in series between an output terminal A1 and an input terminal B1. The terminal of one of the pair of electrodes 12 of the protective device 10 is connected to the input terminal B1, while the terminal of the other electrode 12 is connected to the output terminal A1. The fusible conductor 13 has its median point connected to one terminal of the heating member 15 and the terminal of one of the electrodes 21 connected to the other terminal of the heating member 15. The other terminal of the heating member 15 is connected to the collector of a transistor Tr, the emitter of the transistor Tr is connected to a point intermediate between another input terminal A2 and another output terminal B2. A Zener diode ZD has an anode connected via a resistor R to the base of the transistor Tr. The cathode of the Zener diode ZD is connected to the output terminal A1. The resistor R is set to a value such that, in case a an unusual (meaning, e.g., abnormal, unexpected, etc.) voltage is applied across the output terminals A1 and A2, a voltage in excess of a breakdown voltage will be applied to the Zener diode ZD.

There are connected electrode terminals of a plurality of secondary cells 23, such as lithium cells, as devices for protection, across the output terminal A1, A2, and there are connected electrode terminals of a device, such as a charger, not shown, across the input terminals B1 and B2. This device is used as it is connected to the secondary cells 23.

The operation of the protective device 10 according to one or more embodiments of the present invention will now be explained. The secondary cell devices, such as the lithium cell devices, are provided with the over-current over-voltage protective circuit 24. When an unusual voltage is applied across the output terminals A1, A2 during charging of the cell devices, a reverse voltage in excess of the breakdown voltage is applied to the Zener diode ZD at a preset voltage as an unusual voltage. Hence, the Zener diode ZD is rendered electrically conductive. Since the Zener diode ZD is now electrically conductive, a base current Ib flows through the base of the transistor Tr to turn the transistor Tr on. Hence, a collector current Ic flows through the heating member 15 to cause the heating member 15 to be heated. The heat of the heating member 15 is transmitted to the fusible conductor 13 of the low melting metal mounted on top of the heating member 15 to fuse the fusible conductor 13 off. This breaks the electrical connection between the input terminal B1 and the output terminal A1 to prevent an over-voltage from being applied across the output terminals A1 and A2. In case an unusual current flows towards the output terminal A1, the fusible conductor 13 is similarly heated by the current and fused off.

Figure 5:
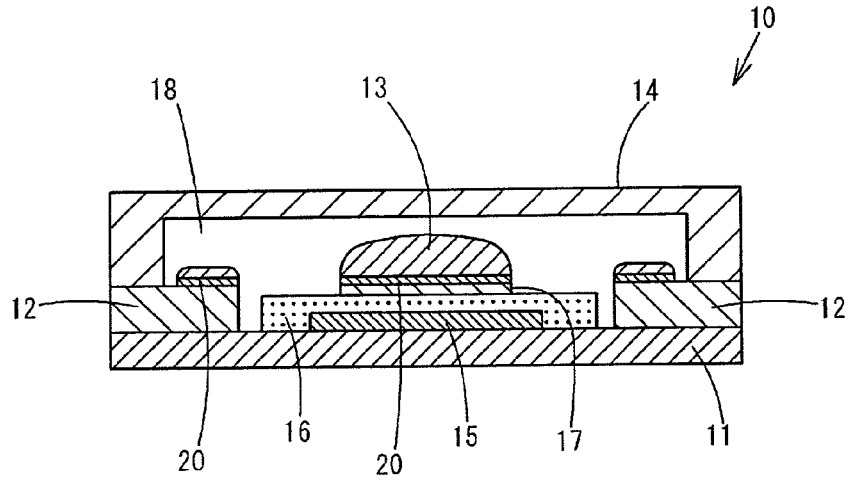
FIG. 5 is a longitudinal cross-sectional view of the protective device according to one or more embodiments of the invention.
Figure 6:
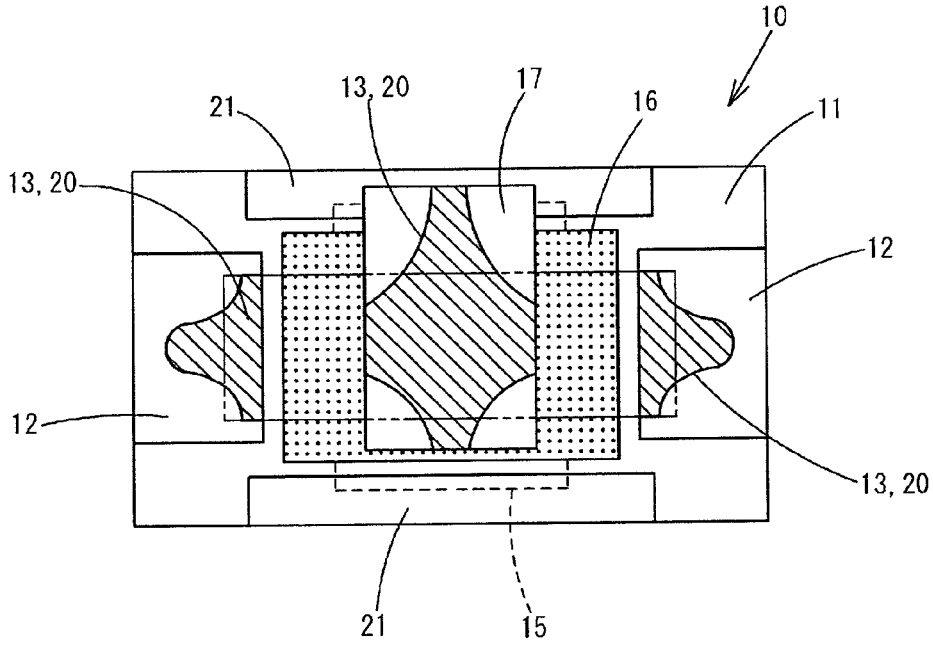
FIG. 6 is a plan view of the protective device according to one or more embodiments of the invention.

Turning to the protective operation by the protective device 10, the metal alloy particles of the solder paste 20 are initially fused and spread over the electrodes 12 and the electrically conductive layer 17. Almost simultaneously, the fusible conductor 13 is fused off and hence is disrupted, as shown in FIG. 5. At the time of fusion/disruption of the fusible conductor 13, the solder paste 20 is spread widely as it wets the electrodes 12 and the electrically conductive layer 17, over which the solder paste 20 has already become fused and spread as it exerts a wetting action, as shown in FIG. 6. As a result, there is no risk that the fusible conductor 13 heaps up in the spacing 18 below the insulation cover 14 to contact the inner surface of the insulation cover 14.

In the protective device 10 according to one or more embodiments of the present invention, when the fusible conductor 13 is about to be fused off, the solder paste 20 is initially spread widely over the surfaces of the electrodes 12 and the electrically conductive layer 17 to wet the surfaces to provide for stable quick fusion/disruption. Moreover, since the fusible conductor 13 is not in contact with the insulation cover 14, there is no fusion/disruption delay, thereby ensuring that the protective operation is achieved with a protective device of the thinner thickness. In addition, the solder paste 20 simultaneously serves as a solder to immobilize the fusible conductor 13. Hence, the solder paste 20 may be implemented simply by changing the pattern of forming the conventional immobilizing solder paste 20 without increasing the number of steps or costs. Furthermore, the surfaces of the electrodes 12 and the electrically conductive layer 17, provided with the solder paste 20, may be prevented from becoming oxidized, thereby further stabilizing the fusion/disruption characteristics of the fusible conductor 13. In particular, in the characteristics of the low-power heating operation, variations in the operation may be made significantly smaller than in the conventional system. The protective device 10 of high performance may thus be provided. The protective device 10 is far less in operation variations than in the conventional system and reduces the load imposed on environment.

Figure 7:
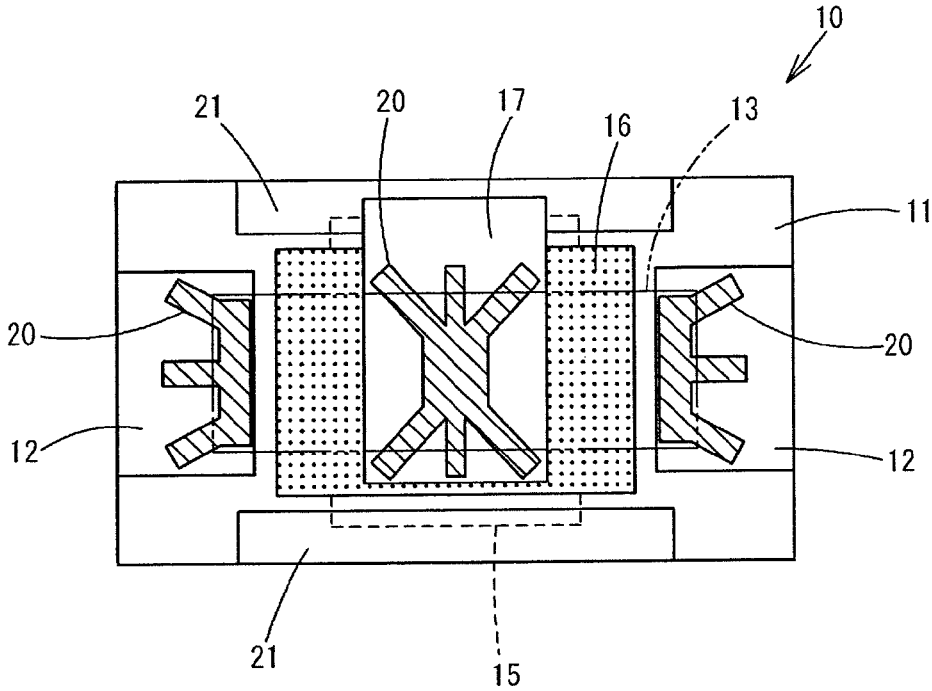
FIG. 7 is a plan view of the protective device according to one or more embodiments of the invention.

A protective device according to one or more embodiments of the present invention will now be explained with reference to FIGS. 7 and 8. Like components, including those already discussed above, are depicted by the same reference numerals. Explanations of components already described above will be omitted for the sake of brevity. In the protective device 10 according to FIGS. 7 and 8, the printing pattern of the solder paste 20 that immobilizes the fusible conductor 13 is changed from that described in reference to FIGS. 1-6. As seen in FIG. 7, the printing lines of the solder paste 20 are extended radially from the mounting position of the fusible conductor 13.

Figure 8:
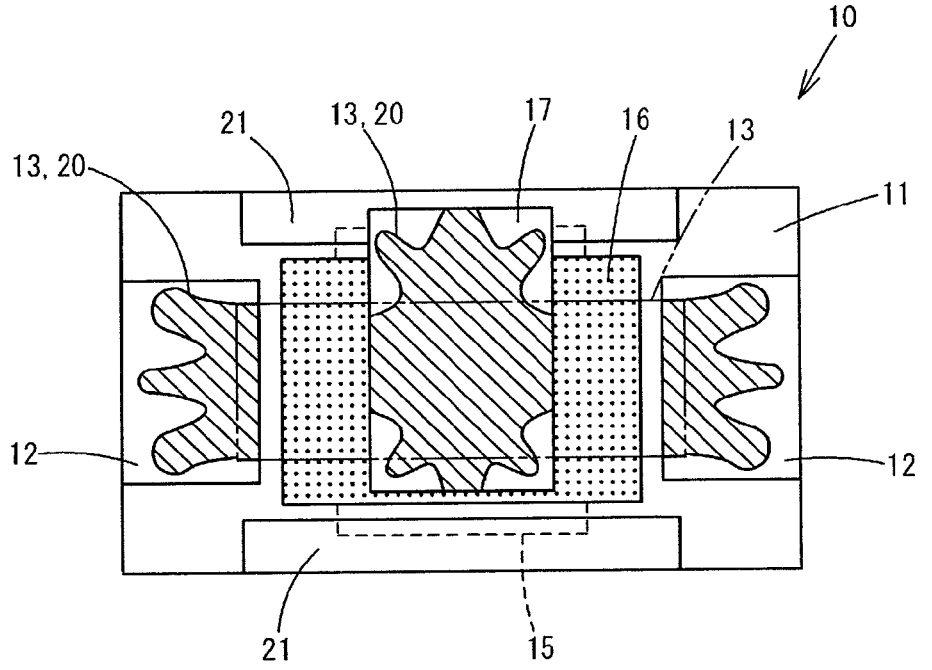
FIG. 8 is a plan view of the protective device according to one or more embodiments of the invention.

Turning to the protective operation by the protective device 10, the metal alloy particles of the solder paste 20 are initially fused and spread over the electrodes 12 and the electrically conductive layer 17, as shown in FIG. 8. Almost simultaneously, the fusible conductor 13 becomes fused off. At this time, the fusible conductor 13 is widely spread over the pattern of fusion of the solder paste 20, as the fusible conductor exerts its wetting action, as shown in FIG. 8. Hence, the fused metal of the fusible conductor 13 heaps to a lesser height. One or more embodiments of the present invention may be applied to a protective device of a thin thickness.

Figure 9:
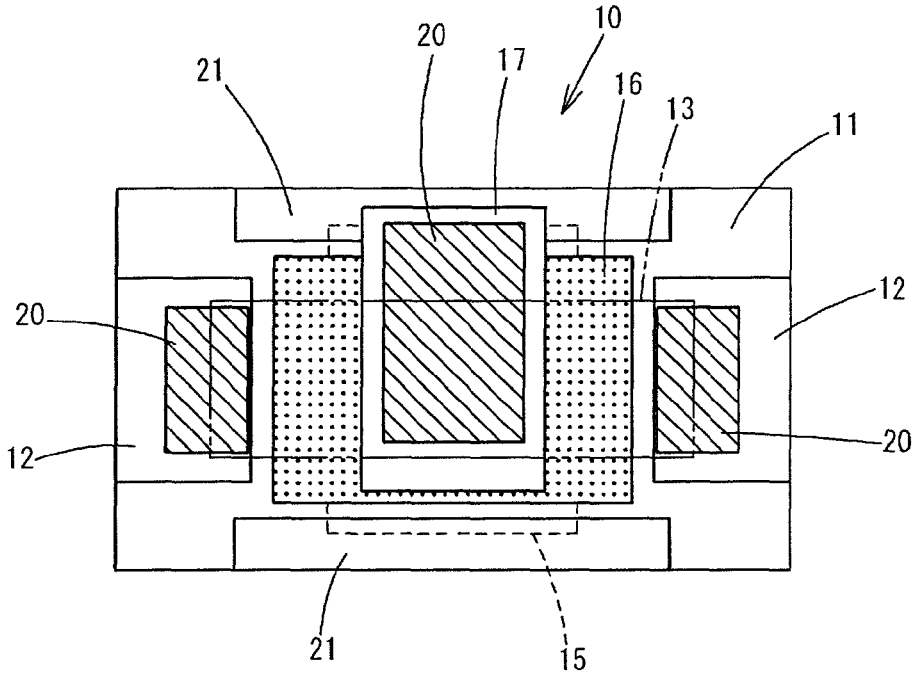
FIG. 9 is a plan view of the protective device according to one or more embodiments of the invention.

A protective device according to one or more embodiments of the present invention will now be explained with reference to FIGS. 9 and 10. Like components, including those already discussed above, are depicted by the same reference numerals. Explanations of components already described above will be omitted for the sake of brevity. In the protective device 10 according to FIGS. 9 and 10, the printing pattern of the solder paste 20 that immobilizes the fusible conductor 13 is further changed from that described in reference to FIGS. 1-8. As seen in FIG. 9, the solder paste 20 is printed or coated on a major portion of the surfaces of the electrodes 12 and the electrically conductive layer 17 where the fusible conductor 13 is mounted.

Figure 10:
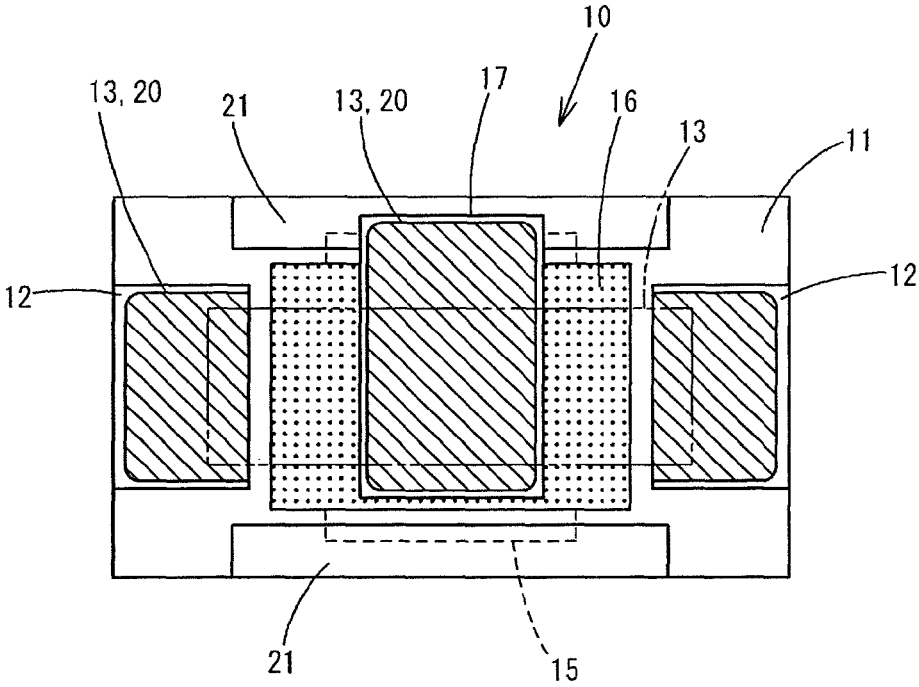
FIG. 10 is a plan view of the protective device according to one or more embodiments of the invention.

In this case, during the operation of protection by the protective device 10, metal alloy particles of the solder paste 20 are fused more widely, and are spread more widely as the solder paste exerts its wetting action, as shown in FIG. 10. Hence, the fused metal of the fusible conductor 13 heaps only to a lesser height than that described in reference to FIGS. 1-8. One or more embodiments of the present invention may be applied to a protective device of a thin thickness.

Figure 11:
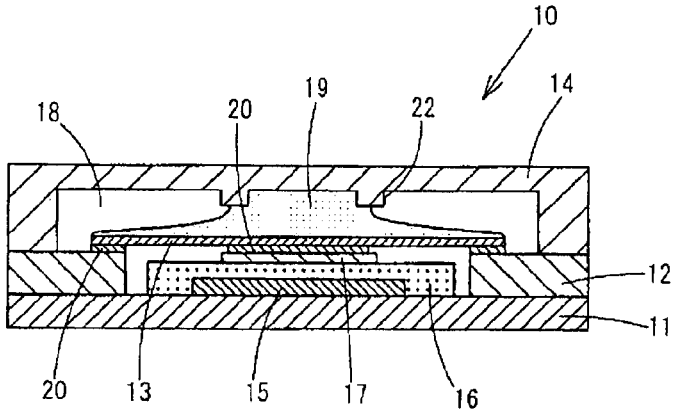
FIG. 11 is a longitudinal cross-sectional view of a protective device according to one or more embodiments of the invention.
Figure 12:
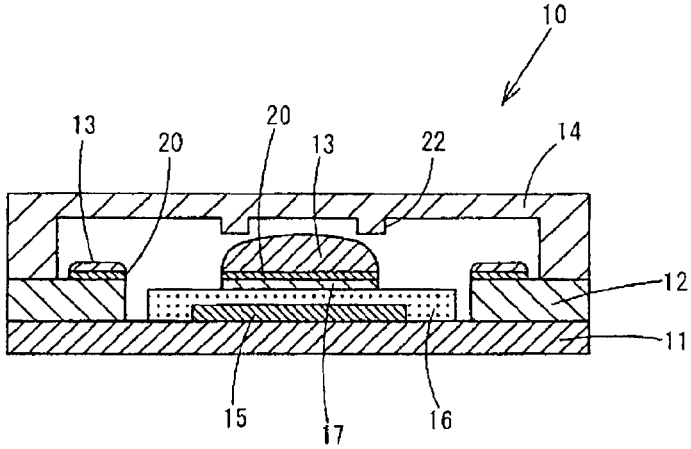
FIG. 12 is a longitudinal cross-sectional view of the protective device according to one or more embodiments of the invention.
Figure 13:
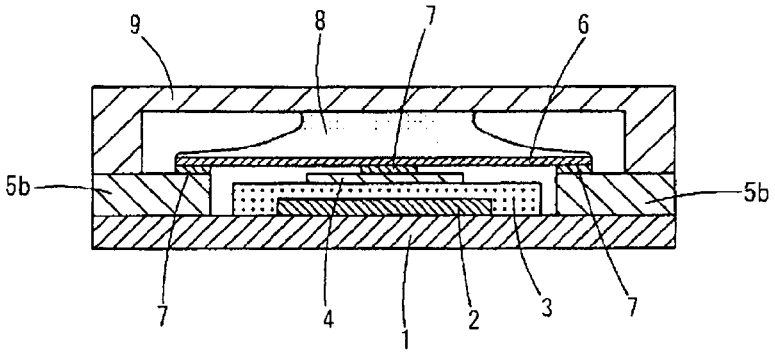
FIG. 13 PRIOR ART
FIG. 13 is a longitudinal cross-sectional view of a conventional protective device.
Figure 14:
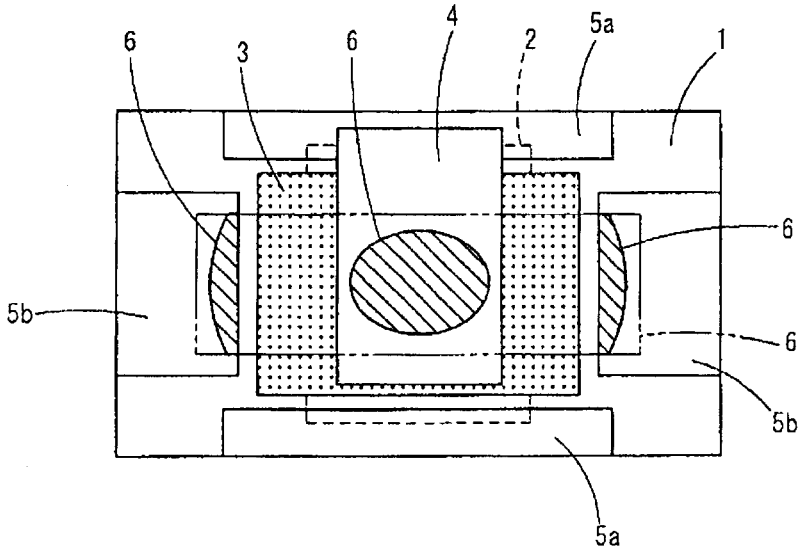
FIG. 14 PRIOR ART
FIG. 14 is a plan view of the conventional protective device.
Figure 15:
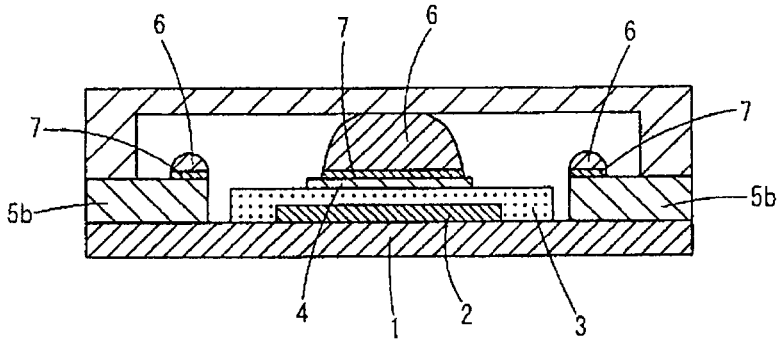
FIG. 15 PRIOR ART
FIG. 15 is a longitudinal cross-sectional view of the conventional protective device.

A protective device according to one or more embodiments of the present invention will now be explained with reference to FIGS. 11 and 12. Like components, including those already discussed above, are depicted by the same reference numerals. Explanations of components already described above will be omitted for the sake of brevity. In the protective device 10 according to FIGS. 11 and 12, the printing pattern of the solder paste 20 that immobilizes the fusible conductor 13 is the same as that described in reference to FIGS. 1-10. However, according to one or more embodiments of the present invention, a plurality of ribs 22 for holding the flux 19 are provided at a mid portion of the inner surface of the insulation cover 14, as shown in FIG. 11. The ribs are formed integrally with the insulation cover 14.

The flux 19 according to one or more embodiments of the present invention may be held positively by the ribs 22 formed on the inner surface of the insulation cover 14, so that the flux may be stably retained at the center position of the fusible conductor 13. This may assure a stabilized operation of fusion/disruption. At the time of fusion/disruption, the fusible conductor 13 is not heaped to a higher height such that it does not contact the ribs 22, as shown in FIG. 12. Hence, there is no adverse effect that might otherwise be caused by the ribs 22, such as delay in fusion/disruption.

While the invention has been described with respect to a limited number of embodiments, those skilled in the art, having benefit of this disclosure, will appreciate that other embodiments can be devised which do not depart from the scope of the invention as disclosed herein. For example, the solder paste material or its coating pattern may be selected based on the particular application. There is also no limitation to the types of flux or material. Accordingly, the scope of the invention should be limited only by the attached claims.

EXPLANATION OF REFERENCE NUMERALS

10 protective device
11 base substrate
12, 21 pair electrodes
13 fusible conductor
14 insulation cover
15 heating member
16 insulation layer
17 electrically conductive layer
19 flux
20 solder paste

The invention claimed is:

1. A protective device for protecting equipment, the protective device comprising:

an insulation base substrate;

a fusible conductor arranged on the insulation base substrate and connected to a power supply path for the equipment so that the fusible conductor is fused off by a preset abnormal current or voltage;

an insulation cover mounted on the insulation base substrate to overlie the fusible conductor via a preset spacing; and a flux coated on a surface of the fusible conductor facing the insulation cover and disposed in the spacing, wherein the fusible conductor is fused off to break a current path when the abnormal voltage is applied to the equipment, wherein the fusible conductor is secured to a conductor layer and to a pair of electrodes provided on the insulation base substrate via an electrically conductive paste containing a metal component exhibiting wettability with respect to the fusible conductor in the fused state, wherein a melting temperature of the metal component of the electrically conductive paste is lower than a melting temperature of the fusible conductor, and the electrically conductive paste is spread more outwards on the conductor layer than a rim of the fusible conductor, wherein the insulation cover includes ribs for holding the flux at a center of an inner surface of the insulation cover, wherein the ribs for holding the flux are formed integrally with the insulation cover such that the flux is held at the center of the inner surface of the insulation cover and the ribs do not contact the insulation base substrate, and wherein the flux contacts the fusible conductor only at the surface of the fusible conductor facing the insulation cover.

2. The protective device according to claim 1, wherein the electrically conductive paste is a solder paste that immobilizes the fusible conductor with respect to the conductor layer and the pair of electrodes.

3. The protective device according to claim 2, wherein a flux component remains in the solder paste even after the solder paste has immobilized the fusible conductor on surfaces of the electrodes.

4. The protective device according to claim 1, wherein the electrically conductive paste is spread radially from the rim of the fusible conductor on a surface of the conductor layer.

5. The protective device according to claim 1, wherein the electrically conductive paste is spread radially from the rim of the fusible conductor on surfaces of the electrodes.

6. The protective device according to claim 1, wherein the electrically conductive paste is spread on the surface of the conductor layer from the rim of the fusible conductor towards a rim of the conductor layer.

7. The protective device according to claim 1, wherein the electrically conductive paste is spread on surfaces of the electrodes from the rim of the fusible conductor towards rims of the electrodes.

* * * * *